United States Patent [19]

Benson

[11] Patent Number: 4,984,442

[45] Date of Patent: Jan. 15, 1991

[54] KEY HOLDER

[76] Inventor: Merritt D. Benson, 9 Southlake Dr., Barrington, R.I. 02806

[21] Appl. No.: 468,032

[22] Filed: Jan. 22, 1990

[51] Int. Cl.[5] ..... A47G 29/10

[52] U.S. Cl. ..... 70/456 R; 70/459

[58] Field of Search ..... 70/456 R, 456 B, 459; 24/3 K, 652–654

[56] References Cited

U.S. PATENT DOCUMENTS

| | | | |
|---|---|---|---|
| 2,679,674 | 6/1954 | Hanna | 70/456 B |
| 2,823,537 | 2/1958 | Segal | 70/459 |
| 3,442,103 | 5/1969 | LePage | 70/456 B |
| 3,478,550 | 11/1969 | Salvesen | 70/459 |

FOREIGN PATENT DOCUMENTS

| | | | |
|---|---|---|---|
| 2302067 | 11/1978 | France | 70/459 |

*Primary Examiner*—Robert L. Wolfe

*Attorney, Agent, or Firm*—Salter & Michaelson

[57] ABSTRACT

A key holder includes a body portion, and a depressible plunger element of generally J-shaped configuration in the body portion which is operative for detachably retaining a key in assembled relation with the body portion. In one embodiment of the key holder the plunger element is engageable with a releasable pin element having a key ring thereon for releasably retaining the pin element and the key ring in assembled relation with the body portion. In a second embodiment the plunger element is engageable with a pin element attached to the body portion for retaining an open ring element attached to the pin element in a closed position wherein a key receive on the ring element is retained thereon. The plunger element in the second embodiment is depressible to permit pivoting of the pin and ring elements to an open position wherein a key received on the ring element is removable therefrom. In a third embodiment a portion of the plunger element travels in an open slot in the body portion and is operative for releasably securing a key ring received in the slot.

23 Claims, 2 Drawing Sheets

KEY HOLDER

BACKGROUND AND SUMMARY OF THE INVENTION

The instant invention relates to key holders and more particularly to a key holder which is adapted for releasably securing a preselected key or group of keys thereto in a manner which permits the key or group of keys to be quickly and easily detached from the main portion of the key holder when desired.

A wide variety of key rings, key holders and key cases have been heretofore available for receiving and maintaining keys in assembled sets so that they are less likely to be lost or misplaced. However, it as been found that for various reasons it is often necessary to temporarily disassemble individual keys from key holders to permit the use of the disassembled keys by strangers for specific purposes without also granting the strangers access to the remaining keys on the key holders. For example, it has been found that it is often necessary to permit parking attendants to have access to the ignition keys of automobiles so that the parking attendants can park and/or move the automobiles as required. However, it has been found that under such circumstances it is often not desireable or prudent to give parking attendants all of the keys on key holders since to do so allows the parking attendants to have free and unrestricted access to the locked trunk areas of the automobiles left in their possession as well as free and unrestricted use of the other keys, such as house keys and the like, on the key holders associated with the automobiles. Accordingly, it has been found that it is important for key holders to be constructed so that keys are normally securely retained thereon but so that preselected keys can be readily detached therefrom when desired. It has been further found that it is advantageous for keys to be detachable from key holders with simple and easy single handed manipulations.

The instant invention provides a key holder which can be effectively utilized for retaining a set of keys in assembled relation but which is adapted to permit a preselected key or group of keys to be readily detached from the key holder with a simple and easy single handed manipulation when desired. Specifically, the key holder of the instant invention comprises a body portion, a retaining portion which is assembled in the body portion and operative for releasably receiving keys thereon and a plunger element on the body portion which normally engages the retaining portion to retain it in a predetermined assembled position on the body portion wherein a key received on the retaining portion is connected to the body portion by the retaining portion. The plunger element is depressible for disengaging the plunger element from the retaining portion to permit the retaining portion to be moved to a release position wherein a key on the retaining portion is disconnectable from the body portion.

In a first embodiment of the key holder the body portion preferably has a longitudinally extending bore formed in one end thereof and the retaining portion preferably comprises a pin element which is releasably assembled in the bore in the body portion. Further, the body portion preferably has a pair of spaced substantially parallel transversely extending passages therein and the plunger element is preferably of J-shaped configuration and it preferably includes a pair of spaced substantially parallel legs and a connecting portion which extends between the legs. The plunger element is preferably assembled with the body portion so that the legs of the plunger element are received in the transverse passages in the body portion and the plunger element is normally spring biased to a position wherein the second leg thereof is in engagement with the pin element to retain the pin element in the body portion. One end of the first leg of the plunger element is preferably disposed adjacent a first side edge of the body portion so that it is depressible inwardly into the body portion for disengaging the second leg of the plunger element from the pin element. Further, the body portion preferably has a recess formed along an opposite second side edge thereof and the connecting portion is normally received in the recess along the second side edge of the body portion. The pin element preferably has an annular notch formed therein and the second leg of the plunger element is preferably normally received in the notch in the pin element for retaining the pin element in assembled relation with the body portion. The plunger element preferably includes a button portion which projects outwardly slightly from the first side edge of the body portion to enable the plunger element to be more easily depressed to disengage the second leg of the plunger element from the pin element. In addition, the key holder preferably further comprises means for securing at least one additional key to the body portion at a location which is spaced from the pin element.

In a second embodiment of the key holder of the instant invention the retaining portion includes a pin element and a ring element secured to the pin element, the ring element having an open gap formed therein to permit a key to be received on the ring element. In this embodiment, the pin element is received and secured in a longitudinally extending bore in the body portion and it is biased to a first position wherein the body portion obstructs the gap in the ring element to prevent the removal of a key from the ring element. In this embodiment he plunger element normally engages the pin element to retain it in the first position thereof. However, the plunger element is depressible for disengaging it from the pin element to permit the pin element to be moved to a second position wherein the gap in the ring element is unobstructed so that a key can be assembled on or removed from the ring element. In this embodiment the pin element again preferably has a notch formed therein and the plunger element, which is preferably of J-shaped configuration, is engageable with the pin element in the notch to retain the latter in the first position thereof. The legs of the J-shaped plunger element preferably travel in first and second passages which extend in substantially perpendicular relation to the bore in the body portion. Further, the body portion preferably has a recess formed therein along one side edge of the body portion and the connecting portion of the plunger element which extends between first and second legs thereof is preferably receivable in the recess.

In a third embodiment of the key holder of the instant invention the body portion has an open slot formed therein along one peripheral edge thereof and the retaining portion includes a ring element which is releasably received in the slot. In this embodiment a portion of the plunger element passes through the slot and is receivable through the ring element or releasably retaining the ring element on the body portion. However, the plunger element is depressible for removing the ring element from the plunger element and for thereby disconnecting the ring element from the body portion. The plunger element is preferably biased to a position wherein it extends across the slot and the plunger element is preferably of J-shaped configuration, including opposite first and second legs and a connecting portion extending between the legs. In this embodiment the first leg of the J-shaped plunger element is depressible for moving the second leg in the slot in order to disengage the second leg from the ring element. Further, the body portion preferably has a recess formed therein and the connecting portion is preferably receivable in the recess.

It has been found that the key holder of the instant invention can be effectively utilized for retaining keys in assembled relation in a manner which permits one or more of the keys to be quickly and easily disassembled from the key holder when desired. In particular, it has been found that because of the manner in which the plunger element operates to retain the retaining portion in assembled relation with the body portion, the plunger element can be readily and easily depressed to disengage it from the retaining portion so that one or more keys connected to the body portion by the retaining portion can be disconnected from the body portion. It has been further found that because of the manner in which the plunger element is assembled in the body portion, the key holder can be conveniently held in one hand while the plunger element is depressed with a finger or thumb on the same hand to disconnect a key from the body portion. It has been still further found that as a result, one or more keys can be readily and easily disassembled from the key holder or reassembled therewith when desired.

Accordingly, it is a primary object of the instant invention to provide an effective key holder wherein one or more keys can be readily and easily disassembled from the key holder when desired.

Another object of the instant invention is to provide an effective key holder which permits one or more keys to be disengaged therefrom with a simple manipulation which can be carried out with one hand.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
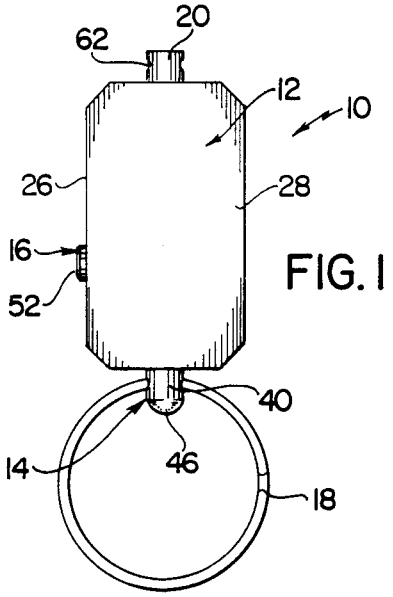
FIG. 1 is a plan view of a first embodiment of the key holder of the instant invention.
Figure 2:
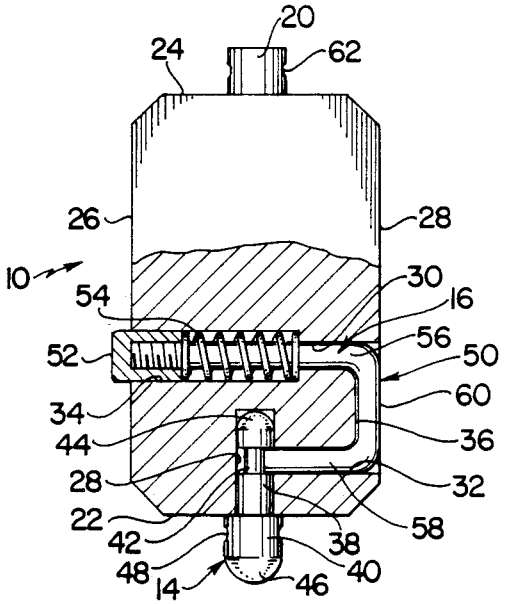
FIG. 2 is an enlarged fragmentary side elevational view thereof with the plunger element in engagement with the pin element.
Figure 3:
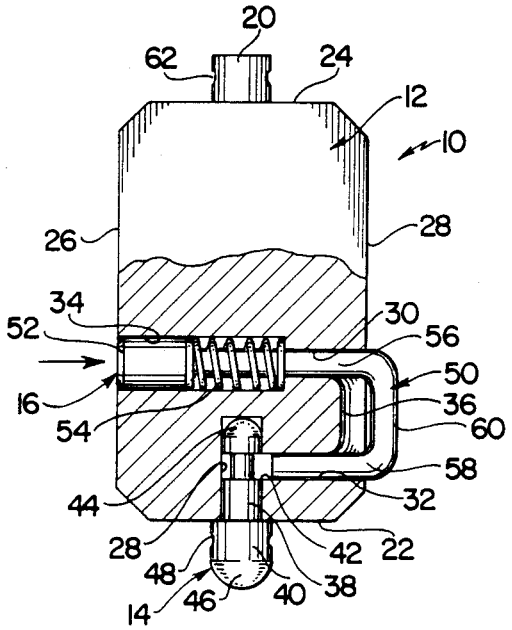
FIG. 3 is a similar view with the plunger element disengaged from the pin element.

Referring now to the drawings, a first embodiment of the key holder of the instant invention is illustrated and generally indicated at 10 in FIGS. 1–3. The key holder 10 comprises a body portion generally indicated at 12, a retaining or pin element generally indicated at 14, a plunger element 16, a key ring 18 and a secondary retainer pin 20. The pin element 14 is received in the body portion 12 and it is normally releasably retained in assembled relation with the body portion 12 by the plunger element 16 in the manner illustrated in FIG. 2. However, the plunger element 16 is depressible for disengaging it from the pin element 14 in the manner illustrated in FIG. 3 so that the pin element 14 and any keys assembled on the key ring 18 can be disassembled from the body portion 12. The secondary pin 20 is operative for receiving a secondary key ring (not shown) thereon for securing one or more additional keys to the body portion 12.

The body portion 12 is preferably made from a suitable, substantially rigid material, such as a metal or plastic in a configuration similar to that illustrated so that various logos, designs, etc. can be effectively applied to the opposite surfaces thereof. As herein embodied the body portion 12 includes longitudinally opposite first and second ends 22 and 24, respectively, and transversely opposite first and second side edges 26 and 28, respectively. The body portion 12 has a bore 28 formed therein which extends inwardly from the first end 22 and first and second passages 30 and 32, respectively, which extend transversely across the body portion 12 in substantially perpendicular relation to the bore 28. The first passage 30 extends through the body portion 12 and it includes an enlarged portion 34 which extends inwardly from the first edge 26. A recess 36 which extends between the first and second passages 30 and 32, respectively, is formed along the second side edge 28 of the body portion 12.

The pin element 14 includes a reduced main portion 38 which is dimensioned to be received in the bore 28 and an enlarged terminal portion 40. The main portion 38 has an annular notch or groove 42 formed therein and a rounded inner end 44. The terminal portion 40 includes a rounded terminal end 46 and an aperture 48 extends through the terminal portion 40 for receiving the key ring 18.

The plunger element 16 includes a main portion generally indicated at 50 of generally J-shaped configuration, an end cap 52 and a coil spring 54. The main portion 50 includes spaced substantially parallel first and second legs 56 and 58, respectively, which are connected by a connecting portion 60. The first and second legs 56 and 58 are slidably received in the first and second passages 30 and 32, respectively, so that the connecting portion 60 is receivable in the recess 36. The coil spring 54 is assembled on the first leg 56 so that it is received in the enlarged portion 34 of the passage 30 and the end cap 52 is received in threaded engagement on the free terminal end of the first leg 56 for retaining the coil spring 54 thereon. The second leg 58 is dimensioned so that it normally extends into the bore 28 when the connecting portion 60 is received in the recess 36, and it is dimensioned to be received in engagement in the notch 42 in the pin element 14. The plunger element 16 is depressible against the force of the coil spring 54 by depressing the end cap 52 to transversely reposition the main portion 50 with respect to the body portion 12 so that the second leg 58 is disengaged from the pin element 14 in the manner illustrated in FIG. 3.

The key ring 18 preferably comprises a conventional split key ring which is adapted for receiving one or more preselected keys thereon in a conventional manner and it is assembled on the pin element 14 so that it extends through the aperture 48.

The secondary pin element 20 is permanently assembled on the second end 24 of the body portion 12 so that it extends outwardly therefrom as illustrated. The secondary pin element 20 has an aperture 62 therethrough for receiving a second key ring or the like and it is preferably rotatable relative to the body portion 12.

For use and operation of the key holder 10, a preselected key or group of keys is assembled on the ring 18 and one or more additional keys are assembled on a secondary ring (not shown) assembled on the secondary pin 20. During normal use the keys assembled on the key holder 10 in this manner are effectively retained thereon so that they are not inadvertently disengaged from the holder 10 and lost. However, if necessary or desireable, the preselected key or group of keys assembled on the key ring 18 can be quickly and easily disengaged from the body portion 12 so that they can be utilized independently of the body portion 12 and the keys assembled on the secondary pin 20. Specifically, by depressing the end cap 52 in the manner illustrated in FIG. 3, the free terminal end of the second leg 58 of the main portion 50 of the plunger element 16 can be disengaged from the notch 42 in the pin element 14 so that the pin element 14 and the key ring 18 can be separated from the remaining portions of the key holder 10. Thereafter, the pin element 14 and the ring 18 and any keys thereon can be quickly and easily reassembled with the body portion 12 by inserting the pin element 14 into the bore 28 so that the rounded end 44 cams the terminal end of the second leg 58 outwardly until the second leg 58 once again passes into engagement in the notch 42 to resecure the pin element 14 in the bore 28.

Figure 4:
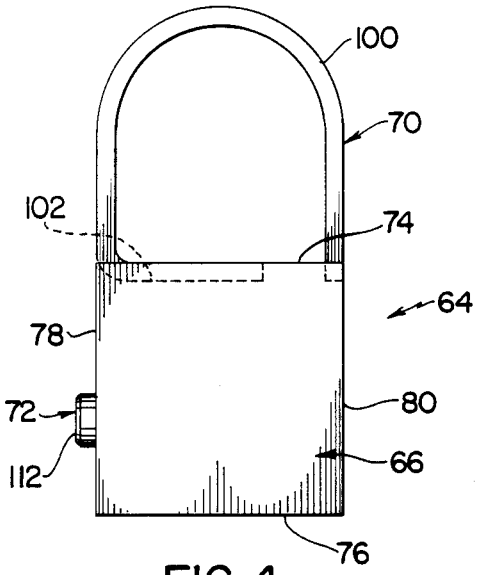
FIG. 4 is a plan view of a second embodiment of the key holder of the instant invention in a closed position.
Figure 5:
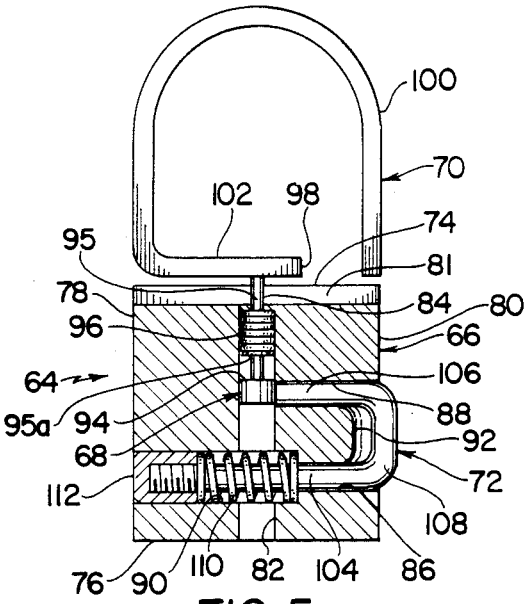
FIG. 5 is a sectional view thereof in an open position.

Referring now to FIGS. 4 and 5, a second embodiment of the key holder of the instant invention is illustrated and generally indicated at 64. The key holder 64 comprises a body portion generally indicated at 66, a pin element generally indicated at 68, an open ring element generally indicated at 70 and a plunger element generally indicated at 72. The pin element 68 is permanently attached to the body portion 66 and the ring element 70 is permanently attached to the pin element 68. The plunger element 72 is engageable with the pin element 68 for retaining the pin element 68 and the ring element 70 in the closed positions thereof illustrated in FIG. 4. However, by depressing the plunger element 72, the plunger element 72 is disengageable from the pin element 68 to permit the pin element 68 and the ring element 70 to be moved outwardly slightly from the body portion 66 and rotated to permit the removal of one or more keys from the ring element 70.

The body portion 66 is preferably made from a suitable rigid material, such as a metal or plastic and again it is preferably formed so that various logos, designs, etc. can be effectively applied to the opposite surfaces thereof. As herein embodied the body portion 66 has opposite first and second ends 74 and 76, respectively, and opposite first and second side edges 78 and 80, respectively. A recess 81 extends along the first end 74 of the body portion 66 and a bore 82 extends inwardly in the body portion 66 from the second end 76 thereof, the bore 82 including a terminal portion 84 of reduced diameter which communicates with the recess 81. First and second passages 86 and 88 extend transversely in the body portion 66, the second transverse passage 88 having an enlarged portion 90. A recess 92 which connects the first and second passages 86 and 88 is formed along the second edge 80 of the body portion 66.

The pin element 68 is of elongated configuration and it has a notch 94 formed therein. The pin element includes a reduced terminal portion 95 and a coil spring 96 is received on the terminal portion 95 of the pin element 68 so that it is captured between the structure **95*a* of the pin element 68 which defines the upper end of the notch 94 and the end of the enlarged main portion of the bore 82. The pin element 68 is received in the bore 82 so that the spring 96 bears against the end of the enlarged main portion of the bore 82 and so that the pin element 68 nevertheless passes through the reduced terminal portion 84. As a result, the spring element 96 biases the pin element 68 toward the second end 76 of the body portion 66**.

The ring element 70 has an open gap 98 formed therein and it includes a U-shaped portion 100 and a base portion 102 which extends integrally from one end of the U-shaped portion 100 toward the opposite end thereof terminating in spaced relation to the opposite end of the U-shaped portion 100. The base portion 102 is permanently connected to the terminal end of the pin element 84. The recess 81 in the body portion 66 and the base portion 102 are formed so that the base portion 102 is receivable in the recess 81. When the ring element 70 is assembled with the body portion 66 so that the base portion 102 is received in the recess 81, the body portion 66 obstructs the gap 98 to prevent the removal of a key received on the U-shaped portion 100 from the ring element 70. However, because the ring element 70 is attached to the pin element 68, the ring element 70 can be moved outwardly slightly from the body portion 66 against the force of the spring 96 to remove the base portion 102 from the recess 81. Once the base portion 102 has been removed from the recess 81, the ring element 70 and the pin element 68 can be rotated relative to the body portion 66 to a position wherein the gap 98 is no longer obstructed by the body portion 66. When the ring element 70 is in this position, a key received on the U-shaped portion 100 can be readily disassembled from the ring element 70 and one or more additional keys can be assembled on the U-shaped portion 100.

The plunger element 72 is of generally J-shaped configuration and it includes first and second substantially parallel legs 104 and 106, respectively, and a connecting portion 108 which extends between the legs 104 and 106. The first and second legs 104 and 106, respectively, are received in the first and second transverse passages 86 and 88, respectively, in the body portion 66. A coil spring 110 is received on the second leg 106 in the enlarged portion 90 of the passage 88 and a cap element 112 is threadedly received on the second leg 106 so that the coil spring 110 is captured between the cap element 112 and the terminal end of the enlarged portion 90. The cap element 112 normally projects outwardly slightly from the first side edge 78 of the body portion 66 so that it is depressible for moving the entire plunger element 72 in a direction toward the second side edge 80 of the body portion 66. When the plunger element 72 is in its normal non-depressed position the first leg 104 projects inwardly into the bore 82 so that it is receivable in the notch 94 in the pin element 68. Accordingly, when the plunger element 72 is in a non-depressed position, the first leg 104 thereof is operative for retaining the pin element 68 in a closed position wherein it is retracted into the body portion 66 so that it is operative for retaining the base portion 102 of the ring element 70 in the recess 81. In other words, the plunger element 72 is operative for retaining the ring element 70 in a closed position wherein the gap 98 is obstructed by the body portion 66.

Accordingly, for use and operation of the key holder 64 the cap element 112 of the plunger element 72 is depressed so that the first leg 104 of the plunger element 72 is withdrawn from the notch 94 in the pin element 68. Once the first leg 104 has been withdrawn from the notch 94, the pin element 68 can be advanced outwardly slightly in a direction toward the first end 74 of the body portion 66 to permit the base portion 102 of the ring element 70 to be removed from the recess 81. Once the base portion 102 has been removed from the recess 81, the ring element 70 can be rotated relative to the body portion 66 to permit one or more keys to be assembled on the U-shaped portion 100. Thereafter, by rotating the ring element 70 and the pin element 68 so that the base portion 102 is realigned with the recess 81, the spring 96 is operative for fully retracting the pin element 68 into the body portion 66 so that the base portion 102 of the ring element 70 is drawn into the recess 81. Further, as the pin element 68 is drawn into the body portion 66, as soon as the notch 94 is aligned with the first leg 104, the first leg 104 is resiliently drawn into the notch 94 to lock the pin element 68 and the ring element 70 in position on the body portion 66.

Figure 6:
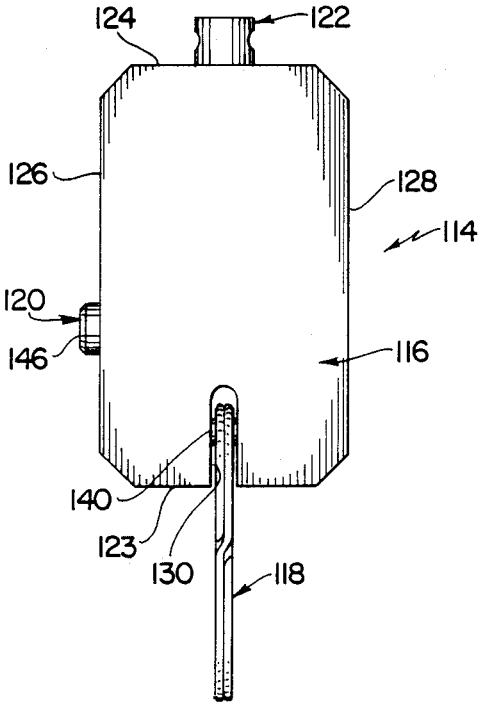
FIG. 6 is a plan view of a third embodiment of the key holder of the instant invention in a closed position.
Figure 7:
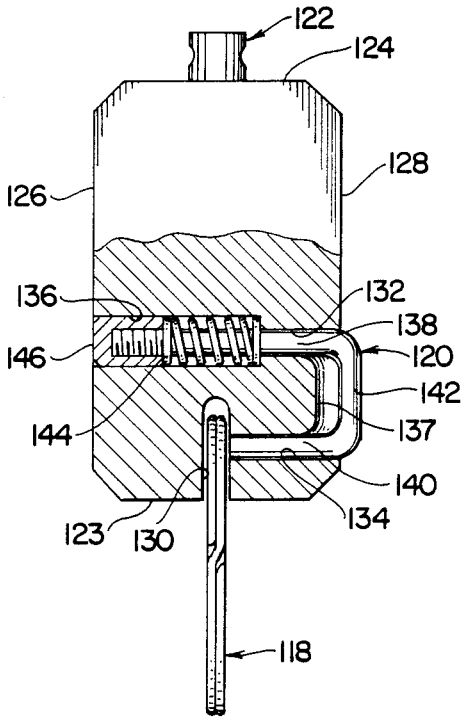
FIG. 7 is a sectional view thereof in an open position.

Referring now to FIGS. 6 and 7, a third embodiment of the key holder of the instant invention is illustrated and generally indicated at 114. The key holder 114 comprises a body portion generally indicated at 116, a key ring or retainer element 118, a plunger element 120 and a secondary retainer pin 122 which is similar to the secondary retainer pin 20 of the key holder 10. The plunger element 20 is operative for retaining the key ring 118 in an assembled position with the body portion 116 in the manner illustrated in FIG. 6. However, the plunger element 120 is depressible to the position illustrated in FIG. 7 wherein the key ring 118 is removable from the body portion 116 in order to disconnect one of more keys received on the key ring 118 from the body portion 116.

The body portion 116 is again preferably constructed from a suitable substantially rigid material, such as a metal or plastic in a configuration which permits various logos, designs, etc. to be applied to the surfaces of the body portion 116. The body portion 116 has opposite first and second ends 123 and 124, respectively, and opposite first and second side edges 126 and 128, respectively. A slot 130 extends inwardly in the body portion 116 from the first end 123 thereof and first and second transverse passages 132 and 134, respectively are also formed in the body portion 116. The first passage 132 includes an enlarged portion 136 which communicates with the first edge 126 of the body portion 116 and a recess 137 extends between the first and second passages 132 and 134, respectively, along the second edge 128 of the body portion 116. The passage 134 communicates with the slot 130 as illustrated in FIGS. 6 and 7.

The key ring 118 preferably comprises a conventional split key ring and it is preferably made from a suitable metal. The key ring 118 is dimensioned to be received in the slot 130 so that it is in substantially perpendicular relation to the body portion 116 as illustrated in FIGS. 6 and 7.

The plunger element 120 is preferably of substantially J-shaped configuration and it includes first and second substantially parallel legs 138 and 140, respectively, and a connecting portion 142 which extends between the legs 138 and 140. The plunger element 120 is assembled in the body portion 116 so that the first and second legs 138 and 140 are received in the first and second transverse passages 132 and 134, respectively, as illustrated in FIG. 7. Assembled on the first leg 138 of the plunger element 120 is a coil spring 144 and a cap element 146 is threadedly received on the terminal end of the first leg 138. The coil spring 144 is captured between the cap element 146 and the inner end of the enlarged portion 136 so that the cap element 146 is resiliently biased to a position wherein it projects outwardly slightly from the first side edge 126 of the body portion 116. When the plunger element 120 is in this position, the second leg 140 extends substantially across the slot 130. However, the plunger element 120 is moveable to a disengaged position by depressing the cap element 146 to advance the plunger element 120 in a direction toward the second side edge 128 of the body portion 116. When the plunger element 120 is moved in this manner, the second leg 140 is withdrawn from the slot 130. Accordingly, the second leg 140 is normally operative for securing the key ring 118 to the body portion 116. However, by depressing the cap element 146 the second leg 140 is withdrawn from the slot 130 so that the key ring 118 can be disassembled from the body portion 116.

For use and operation of the key holder 114 one or more keys are assembled on the key ring 118. The keys are normally connected to the body portion 116 by the key ring 118 which is retained in assembled relation with the body portion 116 by the plunger element 120. However, by depressing the cap element 146 of the plunger element 120 the plunger element 120 is withdrawn from the slot 130 so that the key ring 118 and any keys thereon can be disconnected from the body portion 116.

It is seen therefore that the instant invention provides several effective key holders. One or more preselected keys attached to the key holders 10, 64 and 114 can be quickly and easily disconnected from the respective body portions 12, 66 and 116 thereof by depressing the respective end caps 52, 112 and 146 thereof to move the respective plunger elements 16, 72 and 120 to disengaged positions. Accordingly, preselected keys assembled on the key ring 18, the ring portion 70 or the key ring 118 can be utilized independently of the respective body portions 12, 66 and 116 thereof. However, when desired the preselected keys can be quickly and easily reconnected to the respective body portions 12, 66 and 116 thereof so that the keys are once again firmly retained on their respective key holders 10, 64 or 114. Accordingly, it is seen that the key holders 10, 64 and 114 are simple and easy to operate and that they provide the added security of enabling users to disassemble one or more preselected keys therefrom when desired. As a result, it is seen that the key holders of the subject invention represent significant advancements in the art which have substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A key holder comprising a body portion, retaining means assembled on said body portion operative for releasably receiving and retaining a key thereon and plunger means on said body portion normally engaging said retaining means to retain the latter in a predetermined assembled position with said body portion wherein a key received on said retaining means in connected to said body portion by said retaining means, said plunger means being manually depressible for disengaging said plunger means from said retaining means to permit movement of said retaining means to a release position wherein said key is disconnectable from said body portion, said retaining means comprising releasable pin means releasably assembled on said body portion, said plunger means engaging said pin means to releasably retain it on said body portion, said releasable pin means including a terminal portion which projects outwardly from said body portion when said pin means is assembled therewith, and means for detachably securing a key to said terminal portion of said releasable pin means, said pin means being of elongated configuration, said plunger means including a J-shaped portion having spaced substantially parallel first and second legs which travel in substantially perpendicular relation to said pin means, said second leg normally engaging said pin means to retain the latter in assembled relation with said body portion, said first leg being manually depressible to disengage said second leg from said pin means.

2. In the key holder of claim 1, said pin means having a notch therein, said second leg normally engaging said pin means in said notch to retain the latter in assembled relation in said body portion.

3. In the key holder of claim 1, said plunger means further comprising a connecting portion connecting said first and second legs, said body portion having opposite first and second longitudinally extending side edges and having first and second substantially parallel transversely extending passages therein, said first and second legs traveling in said first and second passages, respectively.

4. In the key holder of claim 3, said body portion having a recess therein along said second side edge, said recess extending between said first and second passages, said connecting portion being normally received in said recess.

5. In the key holder of claim 4, said first leg being depressible for disengaging said second leg from said pin means.

6. In the key holder of claim 5, said plunger means being normally biased to a position wherein said second leg engages said pin means to retain the latter in assembled relation with said body portion.

7. In the key holder of claim 4, said plunger means including a depressible button portion which projects outwardly slightly from said body portion along said first side edge, said button portion being depressible for disengaging said second leg from said pin means.

8. A key holder comprising a body portion, retaining means assembled on said body portion operative for releasably receiving and retaining a key thereon and plunger means on said body portion normally engaging said retaining means to retain the latter in a predetermined assembled position with said body portion wherein a key received on said retaining means is connected to said body portion by said retaining means, said plunger means being manually depressible for disengaging said plunger means from said retaining means to permit movement of said retaining means to a release position wherein said key is disconnectable from said body portion, said plunger means including a J-shaped portion having spaced substantially parallel first and second legs, said second leg normally engaging said retaining means to retain the latter in said predetermined assembled position, said first leg being manually depressible to disengage said second leg from said retaining means.

9. A key holder comprising a body portion, retaining means assembled on said body portion operative for releasably receiving and retaining a key thereon and plunger means on said body portion normally engaging said retaining means to retain the latter in a predetermined assembled position with said body portion wherein a key received on said retaining means is connected to said body portion by said retaining means, said plunger means being manually depressible for disengaging said plunger means from said retaining means to permit movement of said retaining means to a release position wherein said key is disconnectable from said body portion, said retaining means comprising a ring element having an open gap therein for receiving a key on said ring element, and pin means securing said ring element to said body portion, said pin means being biased to a first position wherein said body portion obstructs said gap to prevent the removal of a key from said ring element but being moveable to a second position wherein said gap is unobstructed to permit the removal of a key from said ring element, said plunger means normally engaging said pin means to retain the latter in the first position thereof but being depressible for disengaging said plunger means from said pin means, said pin means being of elongated configuration, said plunger means including a J-shaped portion having spaced substantially parallel first and second legs which travel in substantially perpendicular relation to said pin means, said second leg normally engaging said pin means to retain the latter in assembled relation with said body portion, said first leg being manually depressible to disengage said second leg from said pin means.

10. A key holder comprising a body portion, retaining means assembled on said body portion operative for releasably receiving and retaining a key thereon and plunger means on said body portion normally engaging said retaining means to retain the latter in a predetermined assembled position with said body portion wherein a key received on said retaining means is connected to said body portion by said retaining means, said plunger means being manually depressible for disengaging said plunger means from said retaining means to permit movement of said retaining means to a release position wherein said key is disconnectable from said body portion, said body portion having an open slot formed therein along one edge thereof, said retaining means comprising ring means releasably received in said slot, said plunger means passing through said ring means in said slot for releasably retaining said ring means on said body portion, said ring means being adapted for receiving a key thereon, said plunger means including a J-shaped portion having spaced substantially parallel first and second legs which travel in substantially perpendicular relation to said slot, said second leg normally passing through said slot for retaining said ring means in assembled relation with said body portion, said first leg being manually depressible to disengage said second leg from said ring means.

11. In the key holder of claim 8, said plunger means further comprising a connecting portion connection said first and second legs, said body portion having opposite longitudinally extending side edges and having first and second transversely extending passages therein, said first and second legs traveling in said first and second passages, respectively.

12. In the key holder of claim 9, said plunger means further comprising a connecting portion connecting said first and second legs, said body portion having opposite first and second longitudinally extending side edges and having first and second substantially parallel transversely extending passages therein, said first and second legs traveling in said first and second passages, respectively.

13. In the key holder of claim 12, said body portion having a recess therein along said second side edge, said recess extending between said first and second passages, said connecting portion being normally received in said recess.

14. In the key holder of claim 13, said first leg being depressible for disengaging said second leg from said pin means.

15. In the key holder of claim 14, said plunger means being normally biased to a position wherein said second leg engages said pin means to retain the latter in assembled relation with said body portion.

16. In the key holder of claim 13, said plunger means including a depressible button portion which projects outwardly slightly from said body portion along said first side edge, said button portion being depressible for disengaging said second leg from said pin means.

17. In the key holder of claim 10, said plunger means being spring biased to a position wherein it extends across said slot.

18. In the key holder of claim 10, said body portion having a passage therein which extends in substantially perpendicular relation to said slot, said plunger means being assembled in said passage and traveling therein when said plunger means is manually depressed to disengage said plunger means from said ring means.

19. In the key holder of claim 10, said plunger means further comprising a connecting portion connecting said first and second legs, said body portion having opposite longitudinally extending first and second side edges and having first and second substantially parallel transversely extending passages therein, said first and second legs traveling in said first and second passages, respectively.

20. In the key holder of claim 19, said body portion having a recess therein along said second side edge, said recess extending between said first and second passages, said connecting portion being normally received in said recess.

21. In the key holder of claim 20, said first leg being depressible for disengaging said second leg from said ring means.

22. In the key holder of claim 20, said plunger means being normally biased to a position wherein said second leg extends across said slot.

23. In the key holder of claim 20, said plunger means including a depressible button portion which projects outwardly slightly from said body portion along said first side edge, said button portion being depressible for disengaging said second leg from said ring means.

* * * * *